US005109623A

United States Patent [19]

French

[11] Patent Number: 5,109,623

[45] Date of Patent: May 5, 1992

[54] LOADING DEVICE FOR MUZZLE-LOADING FIREARMS

[75] Inventor: Kendrick L. French, Lebanon, Me.

[73] Assignee: K. W. Thompson Tool Company, Inc., Rochester, N.H.

[21] Appl. No.: 648,570

[22] Filed: Jan. 31, 1991

[51] Int. Cl.[5] ..... F41C 27/00

[52] U.S. Cl. ..... 42/90

[58] Field of Search ..... 42/90, 51, 87; 102/513

[56] References Cited

U.S. PATENT DOCUMENTS

| | | | |
|---|---|---|---|
| 4,050,175 | 9/1977 | Mulinix | 42/90 |
| 4,112,606 | 9/1978 | Griffin | 42/90 |
| 4,373,285 | 2/1983 | Grout et al. | 42/90 |
| 4,466,209 | 8/1984 | Strickland et al. | 42/90 |
| 4,509,284 | 4/1985 | Naber | 42/87 |
| 4,756,110 | 7/1988 | Beltron | 42/87 |
| 4,862,623 | 9/1989 | Delap et al. | 42/90 |
| 5,035,183 | 7/1991 | Luxton | 102/513 |

*Primary Examiner*—Charles T. Jordan

*Attorney, Agent, or Firm*—Blodgett & Blodgett

[57] ABSTRACT

A charge container for use with a muzzle-loading firearm. The charge container has two parts. The first part has an elongated chamber which is open at both ends for containing a projectile. The second part has a chamber which is open at one end for containing a powder charge. The second part also has an elongated plunger which is slidably mounted in the chamber of the first part for pushing the projectile out of the chamber of the first part into the muzzle of the firearm.

3 Claims, 2 Drawing Sheets

FIG. 1
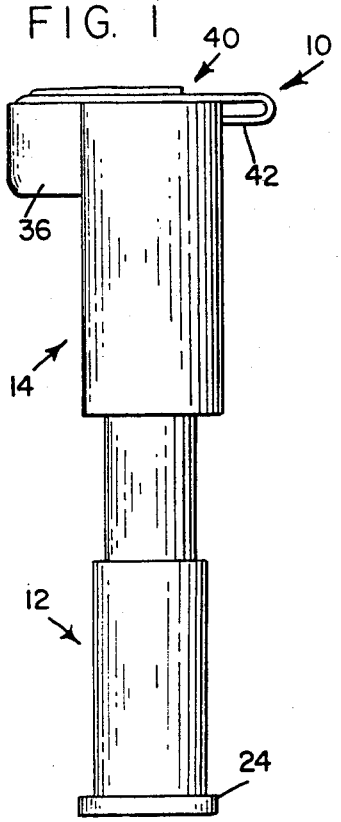
FIG. 3
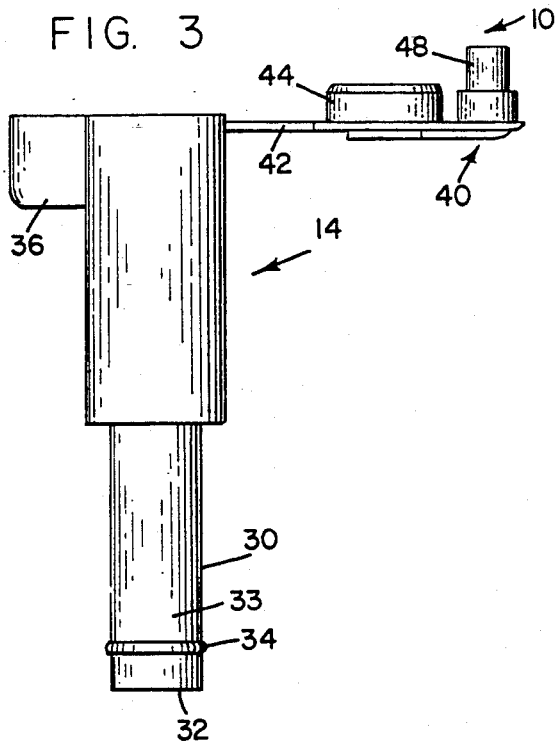
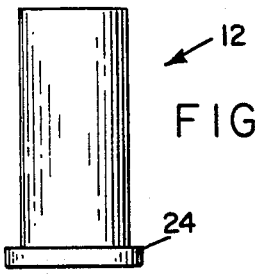
FIG. 5
FIG. 2
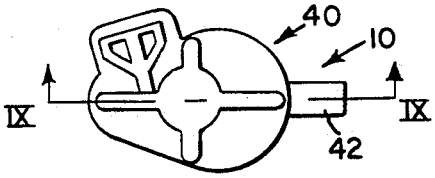
FIG 4
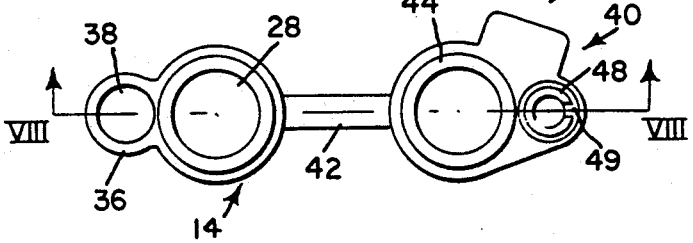
FIG. 6
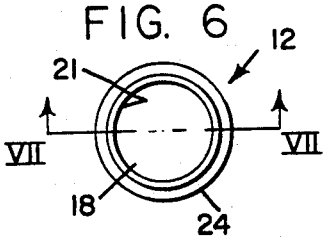

LOADING DEVICE FOR MUZZLE-LOADING FIREARMS

BACKGROUND OF THE INVENTION

The present invention relates to a loading device for a muzzle-loading firearm. The loading of a muzzle-loading firearm is a slow and cumbersome process which involves several components such as gunpowder, a projectile, a patch, and a percussion cap. This process has been simplified substantially by the development of loading devices which conveniently carry the charge components for the firearm and which aid in the loading process itself. One particular loading device includes a body which has a chamber that is open at both ends. A projectile is held in the lower part of the chamber and functions as a closure member for that end of the chamber and gunpowder is held in the upper part of the chamber. The opening which is adjacent the gunpowder is closed by a closure member.

A muzzle-loading rifle is loaded with the aid of the prior art loading device by first pouring the powder charge which is contained in the chamber of the body into the muzzle of the rifle barrel. The lower section of the body is then placed against the muzzle of the rifle barrel and a projectile is pushed from the chamber into the barrel of the rifle with a ramrod. In other words, the loading device and the end of the rifle must both be held in proper alignment with one hand while the ramrod is manipulated with the other hand. This is an extremely difficult procedure with the use of a conventional ramrod so that in most cases a so-called "short starter" is used for the purpose of transferring the projectile from the loading device into the barrel of the rifle. Although the use of a "short starter" makes the loading process a lot easier, the loading device and the barrel must still be held with one hand while the "short starter" is manipulated with the other hand. In addition, the "short starter" represents one more piece of equipment which is required for loading. The usual elongated ramrod must still be used for final positioning of the projectile within the rifle. These and other difficulties experienced with the prior art loading devices for muzzle-loading firearms have been obviated by the present invention.

It is, therefore, a principle object of the invention to provide a loading device for a muzzle loader which contains one or more charge components, including a projectile, and which is effective to transfer the projectile from the loading device and into the muzzle of a rifle barrel without using the ramrod or a "short starter".

Another object of this invention is the provision of a loading device for a muzzle-loading firearm which contains all of the charge components for firing a muzzle-loading firearm.

A further object of the present invention is the provision of a loading device for a muzzle-loading firearm which is simple in construction, easy to carry, and easy to use.

With these and other objects in view, as will be apparent to those skilled in the art, the invention resides in the combination of parts set forth in the specification and covered by the claims appended hereto.

SUMMARY OF THE INVENTION

The invention consists of a charge container for use of a muzzle-loading firearm. The charge container includes a first body which has an elongated projectile chamber which is open at both ends. A second body has a charge chamber which is open at one end for holding a charge of gunpowder. The second body has an elongated plunger which is slidably mounted in the projectile chamber for pushing the projectile out of the projectile chamber and into the muzzle opening of a firearm. The opening to the charge chamber is closed by a cap. More specifically, the cap also contains a primer which fits into an additional cavity in the second body when the opening to the powder chamber is closed by the cover.

BRIEF DESCRIPTION OF THE DRAWINGS

The character of the invention, however, may be best understood by reference to one of its structural forms, as illustrated by the accompanying drawings, in which:

FIG. 1 is a front elevational view of a loading device, embodying the principles of the present invention and showing the closure in the closed condition, FIG. 2 is a top plan view thereof, FIG. 3 is a front elevational view of the portion of the loading device for containing a powder charge and shown with the closure in the open position, FIG. 4 is a top plan view thereof, FIG. 5 is a front elevational view of the portion of the loading device for containing the projectile, FIG. 6 is a top plan view thereof.

DETAILED DESCRIPTION OF THE INVENTION

Figure 8:
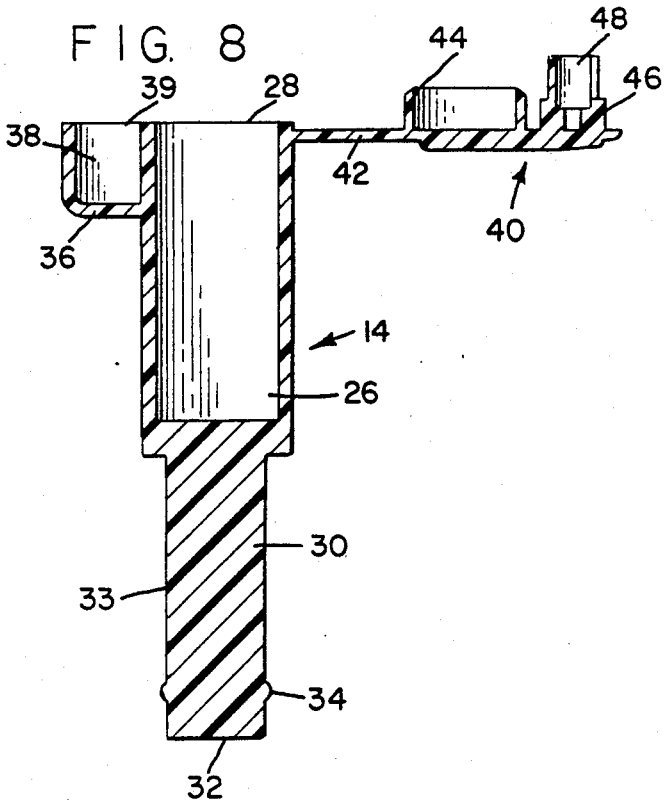
FIG. 8 is a vertical cross-sectional view of the powder holding portion of the loading device taken along the line VIII—VIII of FIG. 4, and looking in the direction of the arrows
Figure 7:
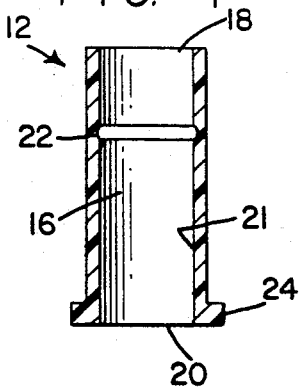
FIG. 7 is a vertical cross-sectional view of the projectile holding portion of the loading device taken along the line VII—VII of FIG. 6, and looking in the direction of the arrows.

Referring to FIGS. 1-7, the loading device of the present invention is generally indicated by the reference numeral 10 and comprises a first body which is generally indicated by the reference numeral 12 and a second body which is generally indicated by the reference numeral 14. The first body 12 is tube shaped and has a cylindrical projectile chamber 16 which is open at both ends, an inlet opening 18 at one end and an outlet opening 20 at the opposite end. The wall of the projectile chamber 16 has an annular groove 22 for a purpose to be described. An outwardly extending annular flange 24 is located near the outlet opening 20.

Figure 9:
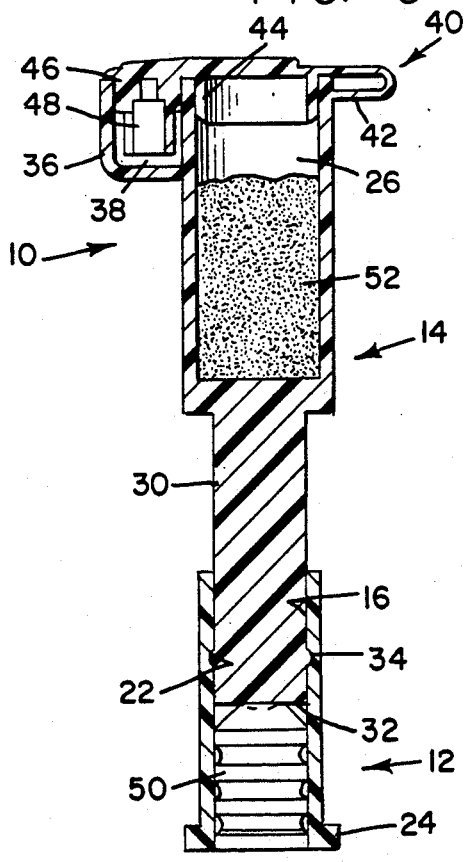
FIG. 9 is a vertical cross-sectional view of the assembled and loaded loading device taken along the line IX—IX of FIG. 2 and looking in the direction of the arrows.

Referring particularly to FIGS. 1-4, 8 and 9, the second body 14 has a cylindrical charge chamber 26 which has a single opening 28 at the top of the chamber. An elongated plunger 30 is located beneath the chamber 26 and has a flat bottom end surface 32 and a cylindrical outer surface 33. An annular bead 34 extends from the cylindrical surface 33 at a point which is spaced from the end surface 32 as shown in FIGS. 2 and 4. The upper end of the body 14 has a protrusion 36 which contains a cavity 38 that is separated from the cavity 26. A closure member, generally indicated by the reference numeral 40, is connected to the body 14 by a flexible and resilient web 42. The web 42 as well as the entire loading device are preferably made of thermoplastic material. The closure member 40 comprises an annular wall 44 and a percussion cap holder 46 which includes a cavity 48 and a longitudinal slot 49. When the closure member 40 is folded about the web 42 as shown in FIG. 9, the annular wall 44 closes the opening 28 and the cap holder 46 closes the opening 39 to the cavity 38.

The loading device 10 is utilized by placing a projectile 50 in the lower end of the chamber 16 and inserting the plunger 30 into the chamber 16 so that the bead 34 snaps into the annular groove 22. This positions the bottom end surface 32 just above the forward end of the projectile 50 as shown in FIG. 9. The chamber 26 is filled with a powder charge 52 and a percussion cap is placed within the cavity 48 of the cap holder 46. The closure member 40 is folded about the web 42 to close the openings 28 and 39 as shown in FIG. 9. The loading device 10 is now ready to be used for loading a muzzle-loading firearm. The muzzle-loading firearm is loaded by opening the closure member 40 and emptying the powder charge 52 into the barrel of the firearm. The projectile 50 is then loaded into the firearm by placing the flange 24 against the muzzle of the firearm so that the opening 20 is aligned with the muzzle opening. The body 14 is pushed toward the muzzle of the firearm, thereby causing the plunger 30 to push the projectile 50 out of the chamber 16 and into the bore of the firearm. A ramrod is then used for pushing the projectile to its final loading position into the barrel of the firearm. The percussion cap is attached to the breech nipple by holding the device in the hand with the forefinger on the backside of the cap socket 48. The cap is pushed onto the nipple with the forefinger and the device is pulled away, leaving the percussion cap on the breech nipple. This slot 49 allows the cap holder 46 to deflect around the percussion cap when the percussion cap is placed on the breech nipple of the firearm.

Clearly, minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A charge container for use with a muzzle-loading firearm, said container comprising:

(a) a first body having an elongated projectile chamber for containing a projectile, said first body having an inlet opening to the chamber at one end of the first body and an outlet opening to the chamber at the opposite end of the first body, said projectile chamber being substantially longer than said projectile said chamber being defined by an inner wall which has first detent means, (b) a second body having a charge chamber for holding a powder charge, an opening to the charge chamber at one end of the second body, and an elongated plunger at the opposite end of the second body which is slidably mounted in said projectile chamber for movement from said inlet opening to said outlet opening, said plunger having a free end for engaging and for pushing a projectile which is located within said projectile chamber out of said projectile chamber through said outlet opening, whereby the projectile is pre-loaded into the muzzle opening of a firearm when the opposite end of the first body is positioned against said muzzle so that said outlet opening is aligned with said muzzle opening, said plunger having an outer surface which has a second detent means for cooperating with said first detent means for positioning and yieldably maintaining the free end of said plunger between said inlet opening and said projectile when said projectile is located in said projectile chamber adjacent said outlet opening, and (c) closure means for sealing the opening to said charge chamber and for confining said powder charge within said charge chamber.

2. A charge container as recited in claim 1, wherein said second body has an additional chamber for containing a priming powder charge and an opening to said additional chamber, and wherein said closure means has a mounting fixture for holding a percussion cap, said mounting fixture being positioned on said closure means so that when said closure means closes the opening to said charge chamber, said mounting fixture closes the opening to said additional chamber.

3. A charge container as recited in claim 1, wherein said closure means is connected to said second body by a flexible strip of material.

* * * * *